US006935279B2

(12) United States Patent
Bosworth

(10) Patent No.: US 6,935,279 B2
(45) Date of Patent: Aug. 30, 2005

(54) TOWEL RAIL OR TOWEL HOLDER

(75) Inventor: Jeremy Damien Bosworth, Birmingham (GB)

(73) Assignee: Heating World Group Limited, Birmingham (GB)

( * ) Notice: Subject to any disclaimer, the term of this patent is extended or adjusted under 35 U.S.C. 154(b) by 0 days.

(21) Appl. No.: 10/851,811

(22) Filed: May 21, 2004

(65) Prior Publication Data

US 2004/0231614 A1 Nov. 25, 2004

(30) Foreign Application Priority Data

May 24, 2003 (GB) ..... 0312004

(51) Int. Cl.[7] ..... H05B 3/06
(52) U.S. Cl. ..... 122/4 R; 219/521; 211/16
(58) Field of Search ..... 122/4 R, 510, 122/493, 373; 211/16; 219/385, 520, 521; 392/416

(56) References Cited

U.S. PATENT DOCUMENTS 4,559,442 A * 12/1985 Graham ..... 219/385
5,548,100 A * 8/1996 Miller ..... 219/521
6,153,862 A * 11/2000 Job ..... 219/521
6,604,942 B2 * 8/2003 Sharp ..... 432/266

FOREIGN PATENT DOCUMENTS

DE 29510820 12/1996
FR 2222985 10/1974

* cited by examiner

*Primary Examiner*—Gregory Wilson
(74) *Attorney, Agent, or Firm*—Andrus, Sceales, Starke & Sawall, LLP

(57) ABSTRACT

A heated towel holder comprises an elongate tube formed into the general shape of a conical helix, supported by a mounting arrangement such that the smaller end of the conical helix shape is lowermost and the axis of that shape extends upwardly at a shallow angle to the vertical. The mounting arrangement feeds heated fluid into one end of the formed tube and allows cooled fluid to drain from the other end of the formed tube. At least the greater part of a towel may simply be dropped into the conical volume bound by the helix so as to remain therein and be heated by fluid flowing through the formed tube.

19 Claims, 7 Drawing Sheets

TOWEL RAIL OR TOWEL HOLDER

CROSS-REFERENCE TO RELATED APPLICATIONS

This application claims priority to Great Britain patent application No. 0312004.5, filed May 24, 2003.

BACKGROUND OF THE INVENTION a) Field of the Invention

This invention relates to a heated towel rail or towel holder. Further, this invention relates to such a towel rail or towel holder in combination with a water manifold arranged to supply hot water to the towel rail or towel holder.

The heated towel rail or towel holder of this invention is primarily intended for use in a domestic bathroom. The terms towel rail and towel holder are used herein more or less interchangeably, as the context requires, to refer to apparatus for the temporary storage of a towel, within a domestic environment, between uses of a towel.

b) Description of the Related Art

Traditionally, a heated towel rail for a bathroom has a pair of upright tubes connected to a domestic hot-water heating system, there being at least one but usually two or more horizontal tubes extending between the upright tubes and through which heated water flows, so that towels hung on the horizontal tubes will be heated and dried. Increasingly, there are calls for more aesthetically-pleasing equipment for use in a domestic environment and as such, towel rails of more attractive designs have been proposed. However, many of these may be difficult to connect to a domestic hot-water heating system, or cannot be used if there is no such heating system.

An aim of the present invention is to provide a towel holder of a novel but aesthetically pleasing design, which is also very convenient and easy to use for the temporary storage of a towel in a bathroom or similar domestic situation. A further aim of a preferred embodiment is to provide an aesthetically attractive heated towel holder which may be connected to a hot water heating system using a manifold expressly for that purpose.

BRIEF SUMMARY OF THE INVENTION

According to this invention, there is provided a heated towel holder comprising an elongate tube formed into the general shape of a conical helix and through which heated fluid is caused to flow, and a mounting arrangement for the elongate formed tube, said mounting being arranged to feed heated fluid into one end of the formed tube and to allow cooled fluid to run from the other end of the tube. The mounting arrangement holds the formed tube with the smaller end of the conical helix lowermost whereby at least a part of a towel may be dropped into the conical volume bound by the helix so as to remain therein and be heated by fluid flowing through the formed tube.

The combination of the shaped elongate tube together with its mounting arrangement allows the provision of an aesthetically attractive towel holder, which is very simple to use and yet effective at drying a used towel. There is no need carefully to fold or arrange a towel when using the towel holder; rather, the towel may simply be tossed into the inverted conical helix-shaped basket defined by the formed tube. Further, the towel holder is easy to furnish within a domestic bathroom, for example by securing the formed tube to a wall using suitable clamps, and then connecting one end of the formed tube to a source of heated fluid and the other end to a return line for that fluid.

Preferred embodiments of the invention will now be described in detail, referring to the drawings as necessary.

BRIEF DESCRIPTION OF THE DRAWINGS

Several specific embodiments of this invention will now be described in detail, though only by way of example, reference being made to the accompanying drawings. In the drawings.

DETAILED DESCRIPTION OF THE INVENTION

Figure 2:
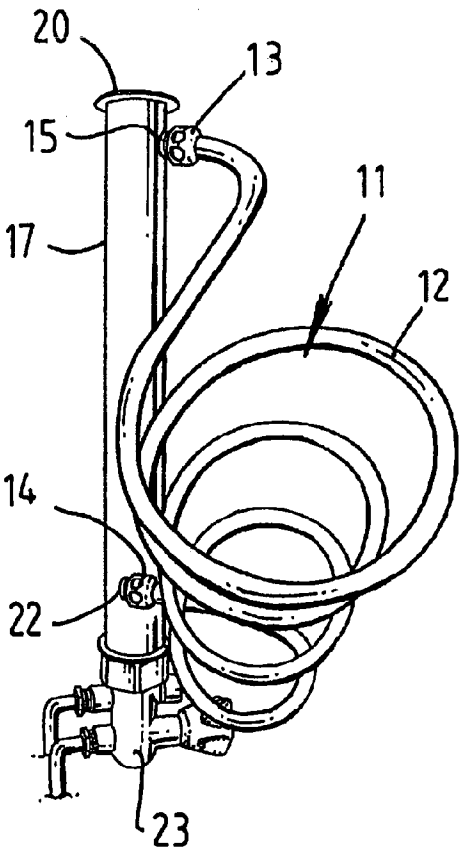
FIG. 2 is a sketch similar to that of FIG. 1 but showing a different manifold.

In one embodiment of this invention, the mounting arrangement includes a pair of parallel pipes adapted for mounting on a vertical surface such as a bathroom wall so as to extend generally vertically. One end of the formed tube should be connected to one pipe and the other end of the formed tube to the other pipe, the two pipes of the pair thereof being connected respectively to the flow and return pipes of a domestic hot water central heating system whereby hot water may be caused to flow through the formed tube. The pair of parallel pipes may be secured together with the formed tube connected thereto such that the towel holder is provided as a complete unit, ready for attachment to a wall and connection to a central heating system.

Preferably, the mounting arrangement includes a manifold comprising a tubular outer body adapted to be mounted in a generally vertical disposition, the upper end of the body being closed off and an inner tube being mounted within the outer body and communicating with the outer body at or adjacent its upper end. The manifold may have a first connector for said one end of the formed tube which first connector communicates with the interior of the outer body adjacent the upper end thereof, and a second connector for said other end of the formed tube which second connector also communicates with the interior of the outer body but adjacent the lower end thereof. The manifold should include means to introduce heated water to the inner tube, thereby in use to promote convection circulation of hot water through the formed tube defining the towel holder.

The manifold permits the construction of a fully self-contained heated towel holder powered by electricity. In this case, the manifold should be provided with an electricallypowered immersion heater within the inner tube and arranged so that when energised, the temperature of the water within the inner tube is raised. This then permits the establishment of a convection heating circuit when a towel holder is connected to the manifold, whereby the hot water will flow through that towel holder.

Preferably, the immersion heater includes an elongate rod-like element which extends at least partway along the length of the inner tube. Such a heater should also have a thermostatic control arrangement as well as conventional safety features associated with immersion heaters. In a preferred construction, the lower end of the outer body is provided with a closure through which the immersion heater passes in a sealing manner, so enabling electrical connections to be made externally of the manifold.

In the alternative, the manifold may be arranged for connection to a domestic hot water central heating system, with the hot feed pipe communicating with the inner tube and the return pipe with the space between the inner tube and the outer body of the manifold.

For this arrangement of the manifold, the inner tube projects internally within the outer body from the lower end thereof towards its upper end, the lower end of the inner tube communicating with a pipe connector externally of the outer body and to which a hot water supply pipe may be secured. In this way, hot water flow to the manifold may be established. The return flow from the manifold may be provided by a tapping on the outer body adjacent the lower end thereof and on which is provided a pipe connector for the return pipe to the central heating system. As an alternative, the lower end of the outer body may have a closure with first and second flow passages, the inner tube connecting with one of the flow passages and the interior of the outer body connecting with the other flow passage.

To permit the control of flow from the domestic central heating system and also to allow isolation for maintenance purposes, each of the two flow passages may be provided with a respective shut-off valve.

The towel holder may be associated with a manifold having a closure for the lower end thereof which comprises a T-piece, one arm of which is threaded or otherwise secured to the outer body. That arm may be divided to provide two separate flow passages, one of which communicates with one of the remaining arms of the T-piece and the other of which communicates with the other of the remaining arms of the T-piece. Then, the flow and return pipes of the domestic central heating system may be connected to those two other arms, respectively.

A plurality of towel holders of this invention and each of a generally similar or identical form may be provided on a single manifold, spaced along the length thereof. To permit this, the manifold may be generally elongate and could either be secured to a wall or upstand from a floor fitting. Further, the plurality of towel holders may be spaced in the circumferential direction, around the manifold.

Figure 1:
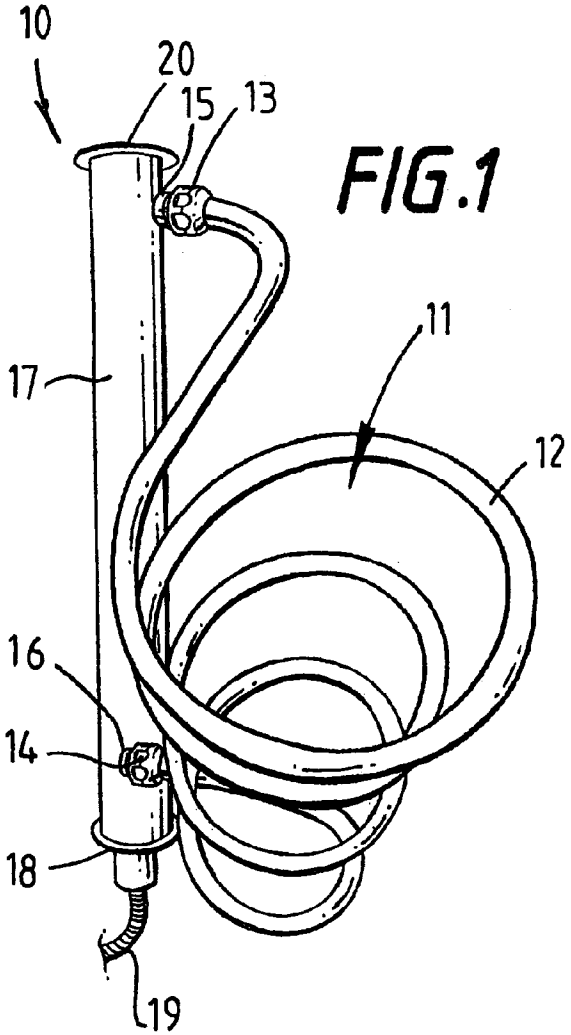
FIG. 1 is a diagrammatic sketch showing a first embodiment of towel holder of this invention in combination with a electrically-heated manifold.
Figure 3:
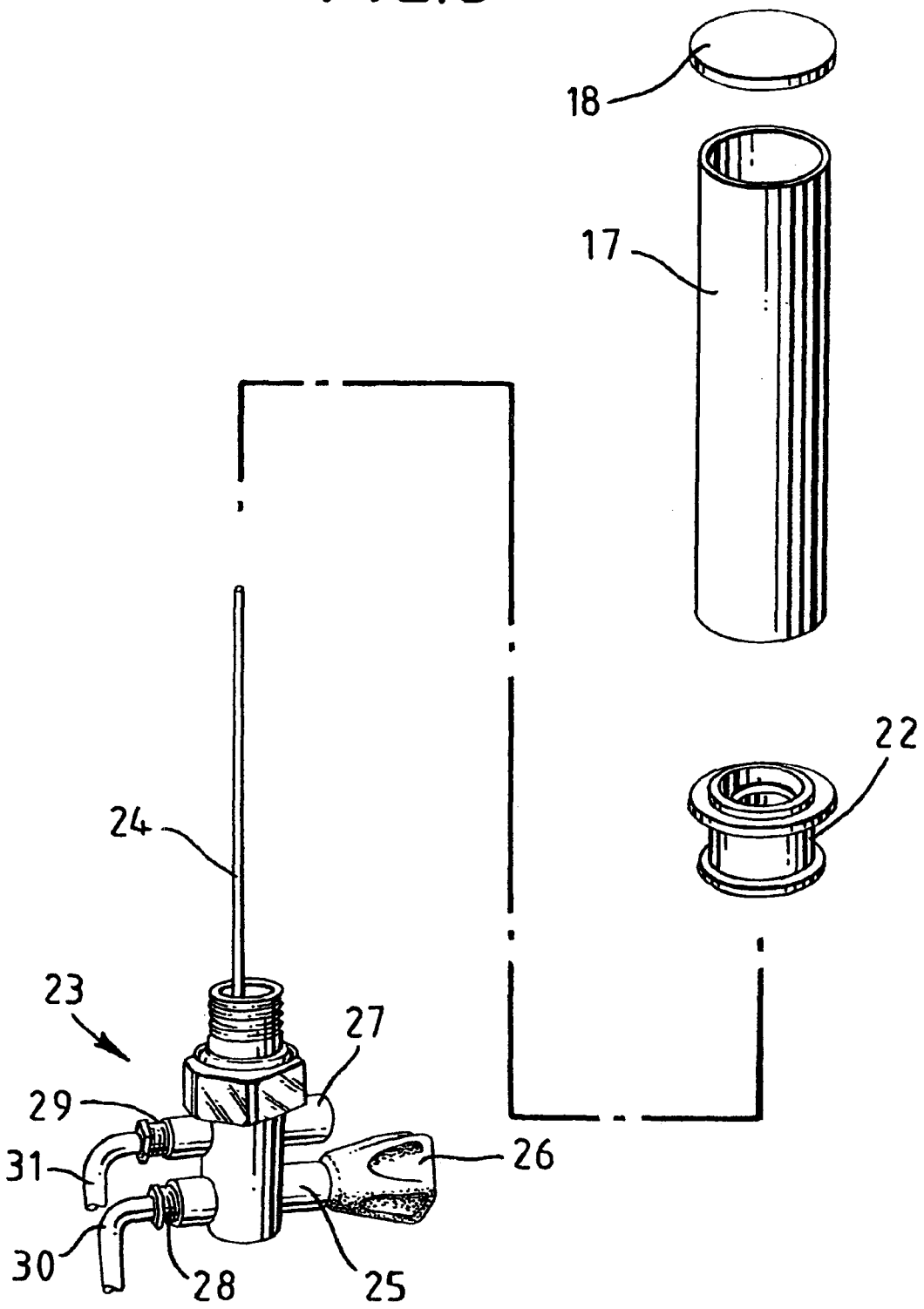
FIGS. 3 and 4 are respectively exploded and partly assembled views of the manifold shown in FIG. 2.
Figure 4:
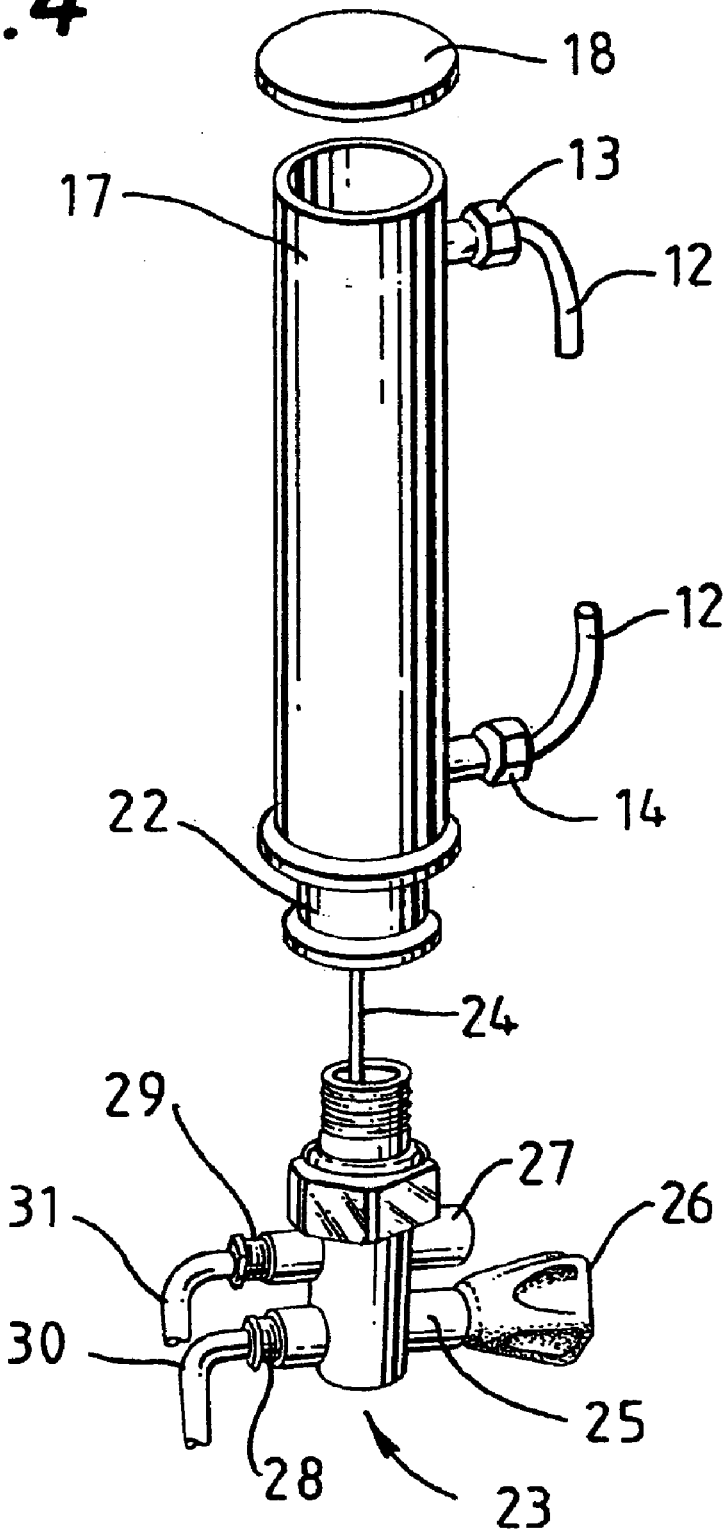

Referring initially to FIG. 1, there is shown an embodiment of heated towel holder 11 of this invention in combination with an electrically-heated manifold 10, for supplying hot water to the towel holder 11. The towel holder 11 comprises a single continuous tube 12 provided with compression fittings 13, 14 at its two ends. The tube is formed to have a generally conical irregular helical shape such that the effective diameter of that shape changes along the axis of the shape. Thus, the formed tube 12 defines an open conical basket and is dimensioned so as to be suitable for holding at least the greater part of a typical domestic bath towel. However, the formed tube could be dimensioned differently, for example to define a smaller basket for holding the greater part of a hand towel.

The towel holder should be aesthetically pleasing, since it will, when installed in a domestic bathroom, be quite noticeable. Thus, the tube typically will be of copper, brass or other ductile material which can be formed into the required shape and is given an attractive non-corroding finish—for example of chromium plating. Alternatively, the formed tube 12 could be of polished or satin-finished stainless steel. Further, the nuts of the compression fittings advantageously are of a more attractive appearance than a simple hexagonal nut and also are finished in a pleasing manner—again, either by polishing if of stainless steel or plating if of other materials.

The towel holder 11 is attached to the manifold 10 solely by its compression fittings 13, 14 at the two ends of the formed tube 12, which compression fittings are engaged with threaded stubs 15, 16 projecting from a tubular outer body 17 of the manifold. The formed tube 12 should have sufficient strength to withstand all normal usage without significant deflection from the intended shape. Further, when mounted on the manifold with the compression fitting 13 vertically above fitting 14, the axis of the conical shape of the holder 11 preferably is out of vertical, and also leaning away from the manifold, all as shown in FIG. 1.

The manifold 10 of FIG. 1 contains an electric immersion heater (not shown) mounted on a lower closure 18 for the tubular body 17. Electric power for the immersion heater is supplied by cable 19. The immersion heater must have a fail-safe thermostat system, to limit the upper temperature of the water in the manifold and also to cut off the supply of electricity in the event of a fault.

The threaded stubs 15, 16 are secured to the outer body 17, typically by a brazing operation. A suitable clamp arrangement (not shown) is provided to secure the manifold 10 to a wall, in the region where the towel holder is to be furnished.

In use, the system of FIG. 1 is filled with water but in such a way as to leave a pocket of air trapped below an upper end cap 20 for the outer body 17, to serve as an expansion chamber as the water is heated. Conveniently, this may be achieved by inverting the system before installation, removing the immersion heater and then filling the manifold with water to the required level, before refitting the immersion heater. An anti-corrosion agent may be added to the water used to fill the heater. Once filled, the manifold is mechanically mounted to a wall by suitable clamps, and the cable 19 is connected to an electrical supply with an isolator switch, possibly also provided with a time switch. When energised, the immersion heater will raise the temperature of the water in the manifold, so promoting a convection flow through the formed tube 12. A towel may be temporarily stored in the holder 11 merely by being tossed into the basket-like shape defined by the formed tube 12. So long as sufficient of the towel is within the shape, it will remain there and will be heated by the water passing through the tube 12.

Referring now to FIGS. 2 to 5, there is shown a manifold which, though generally similar to that described above, does not employ an immersion heater; rather, this manifold is intended for connection to a domestic hot-water space heating system whereby the towel holder 11 connected to the manifold may be heated by water drawn from that space heating system. In FIGS. 2 to 5, like or generally similar parts to those of FIG. 1 are given the same reference numbers and will not be described again here.

The manifold has a tubular outer body 17 provided at its lower end with an internally-threaded ring 22. Threaded into that ring is a valve assembly 23 including an inner tube 24 which extends upwardly within the outer body 17, towards the upper end thereof. The inner tube 24 connects into the valve assembly 23 to the downstream side of a control valve 25 provided in the lower part of that assembly. A control knob 26 is provided externally of the assembly, to permit adjustment of flow into the inner tube 24. The space around the inner tube 24 communicates with a further control valve 27, which may be preset to a required setting but primarily is used to close off the flow passage for maintenance purposes. The valves 25,27 have compression pipe connectors 28,29 to permit the attachment thereto of pipes 30,31 of a domestic central heating system in a manner well known in the art.

Figure 5:
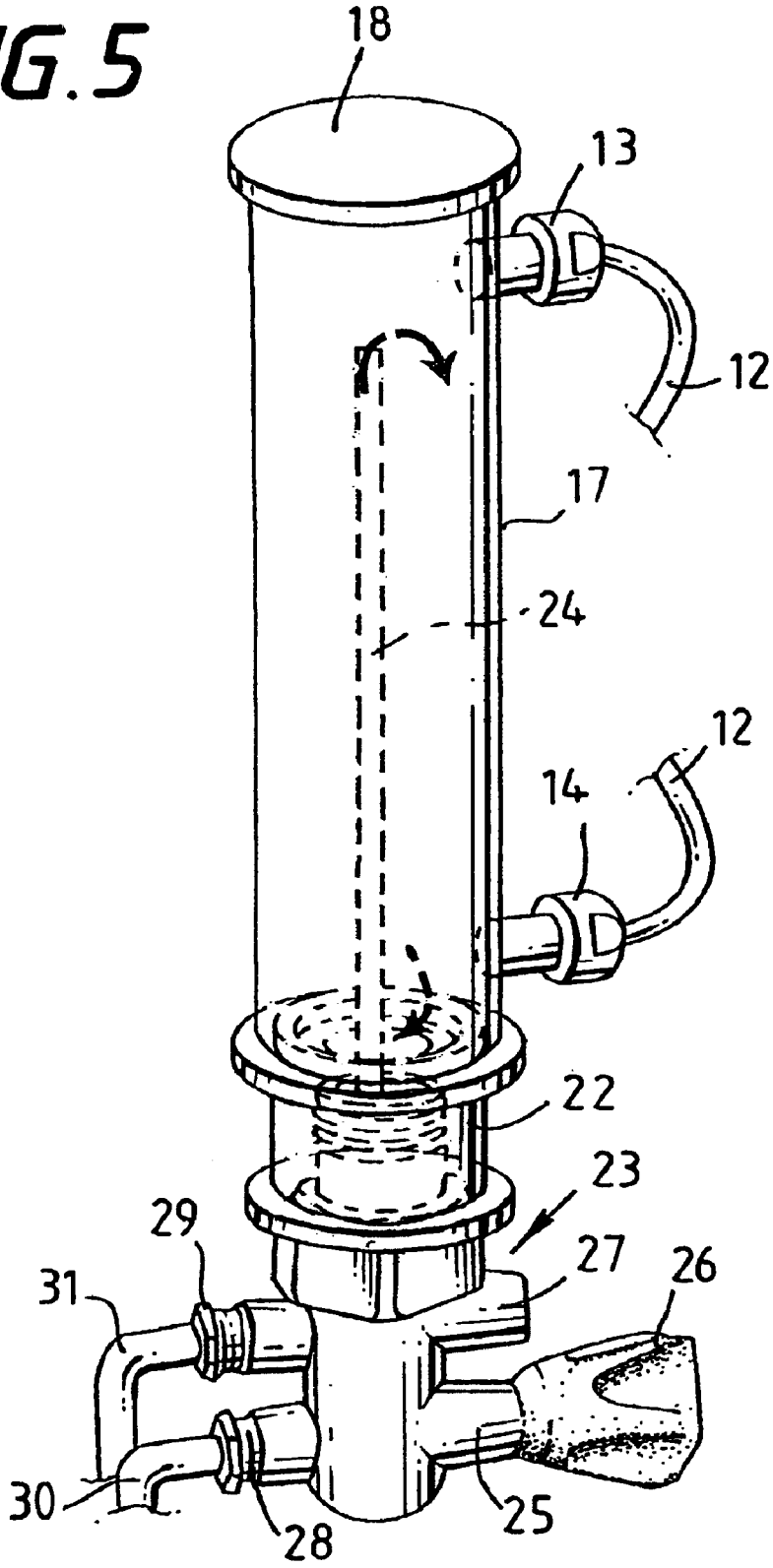
FIG. 5 shows the flow paths through the manifold of FIGS. 3 and 4.

With the valve assembly 23 threaded into the ring 22, hot water from pipe 30 may flow into the inner tube 24, to enter the outer body 17 adjacent the upper end thereof, and water from within the outer body 17 may flow downwardly into pipe 31, all as shown in FIG. 5. Thus, there is a flow path for hot water through the formed tube 12 of a connected towel holder 11.

Figure 6A:
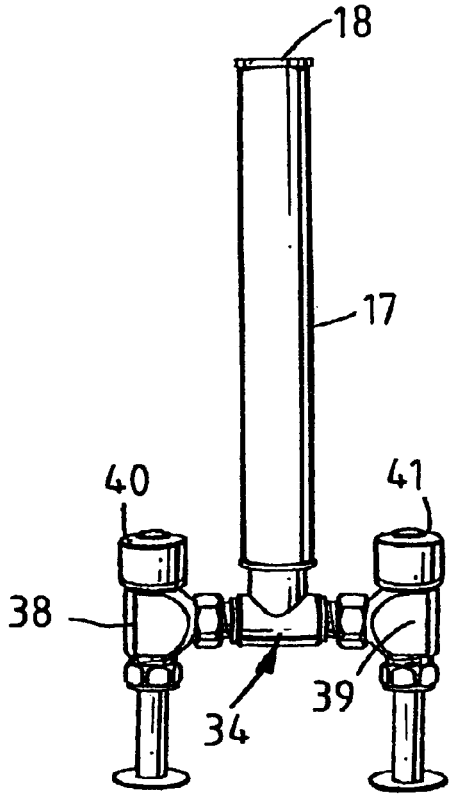
FIG. 6 is an exploded view of a further manifold for use with a towel holder similar to that shown in FIGS. 1 and 2, FIG. 6A being a rear view of the manifold when fitted to a pair of pipes emerging through a floor.
Figure 6:
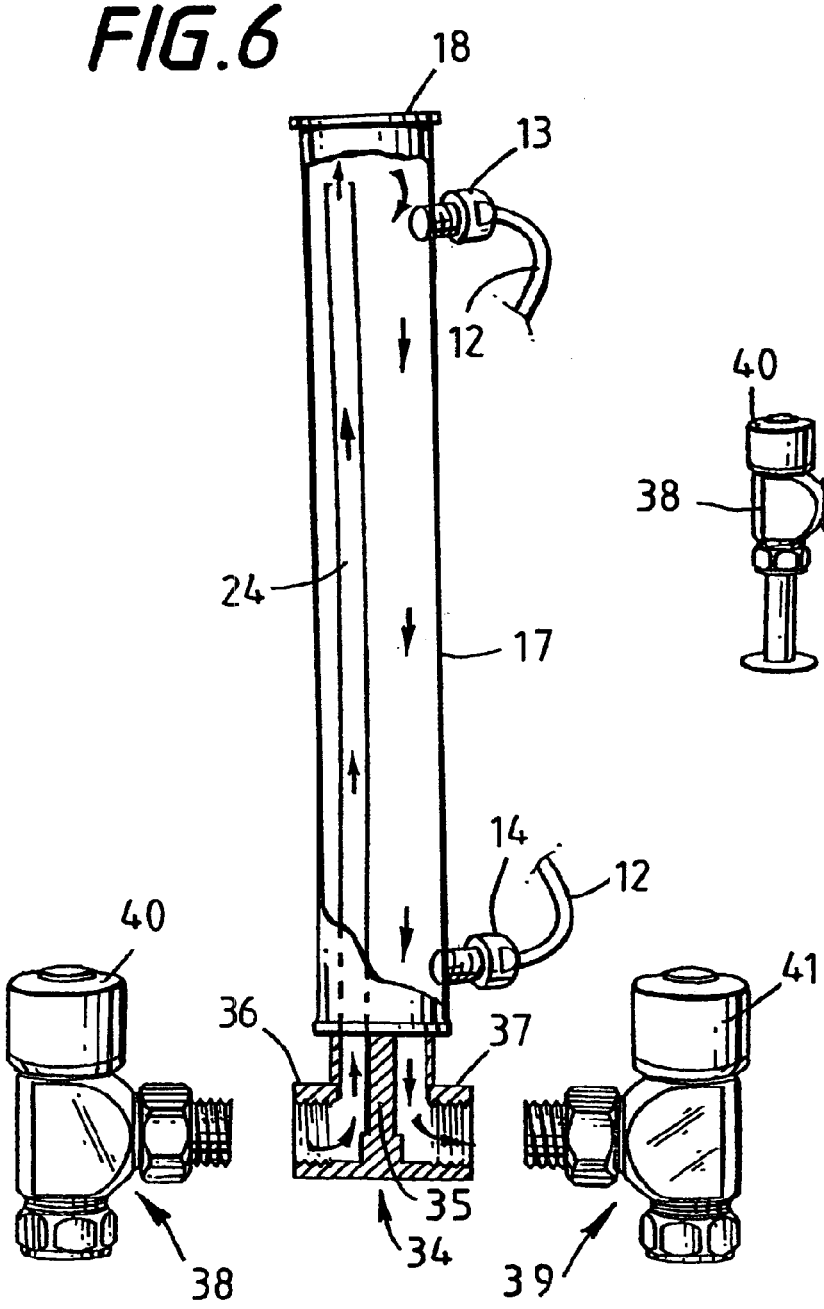

FIGS. 6 and 6A show another manifold having certain similarities to that of FIGS. 2 to 5. Again, like parts are given like reference numbers and will not be described again here.

With the manifold of FIGS. 6 and 6A, the lower end of the outer body 17 is secured to a T-piece 34 having an internal dividing wall 35 to separate arm 36 of the T-piece from arm 37 thereof. The dividing wall 35 is profiled so as to admit the lower end of the inner tube 24 in flow communication with arm 36. The volume of the outer body 17 is in communication with arm 37.

The two arms 36,37 are internally threaded and each is provided with a combined valve and pipe connector 38,39. Each such valve has an adjusting knob 40,41 and permits the attachment thereto of a flow pipe or a return pipe, as appropriate, from a domestic central heating system. The combined valve and pipe connectors 38,39 may be secured to the T-piece 34 in the disposition illustrated in FIG. 6A, to permit the manifold to be secured directly to flow and return pipes emerging through a floor. In the alternative, the connectors 38,39 may be turned through 90° so that they may connect to pipes extending at right angles to the axis of the outer body 17—that is, to pipes leaving a wall at 90° to its surface, with the outer body 17 secured to the wall by a suitable clamp arrangement (not shown).

Once installed, with a towel holder 11 connected to the manifold, the arrangement of FIGS. 6 and 6A functions in precisely the same way as has been described above with reference to FIGS. 2 to 5.

Figure 7:
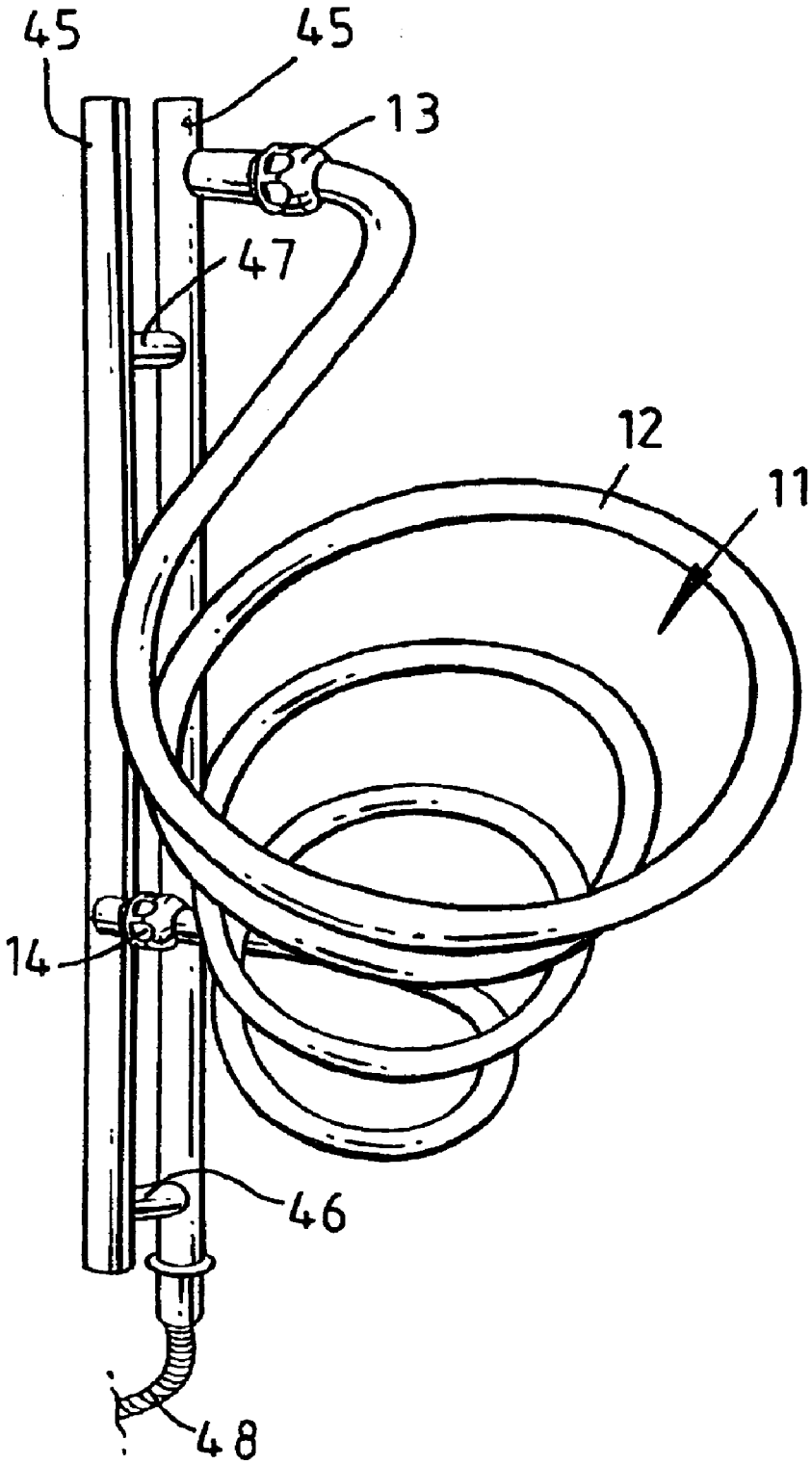
FIG. 7 is similar to FIGS. 1 and 5 but showing an alternative manifold arrangement for use with the towel holder.

FIG. 7 shows the towel holder 11 used with a different manifold arrangement comprising a pair of pipes 45 extending parallel to one another but held spaced apart by lower and upper cross-members 46,47. The compression fitting 13 at the upper end of the formed tube 12 is secured to one of the pipes 45, using a union provided on that pipe, and the compression fitting 14 at the lower end of the formed tube 12 is secured to the other of the pipes 45, again using a union provided on that pipe. A clamp arrangement (not shown) is provided to secure the manifold to a wall—for example by interacting with the cross-members 46,47.

The arrangement of FIG. 7 may be provided with an immersion heater within pipe 45 to which the upper compression fitting 13 is secured, an electric cable 48 for supplying power to the immersion heater extending away from the lower end of that pipe. In this design, the lower cross-member 46 should be hollow and permit the flow of water between the two pipes 45, such that convection circulation may be established on the supply of power to the immersion heater. In an alternative arrangement, the two pipes 45 may be connected respectively to flow and return hot-water pipes of a domestic heating system, whereby water from the supply pipe will flow through the formed tube 12 and then to the return pipe.

Any of the above-described manifolds may be extended so as to have a much greater length than that shown in the drawings. Then, the manifold may support a plurality of towel holders 11 disposed generally one above the other though not necessarily in the same axial line.

Figure 8A:
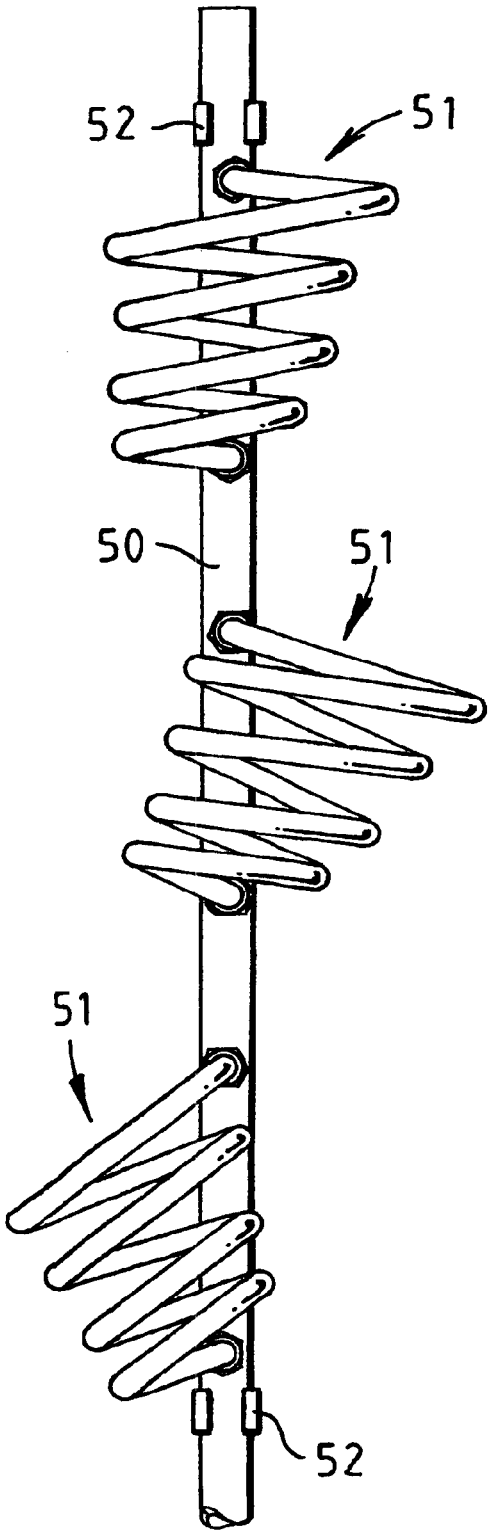
FIGS. 8A and 8B are front and plan views of yet another manifold arrangement, used to support three towel holders of this invention.
Figure 8B:
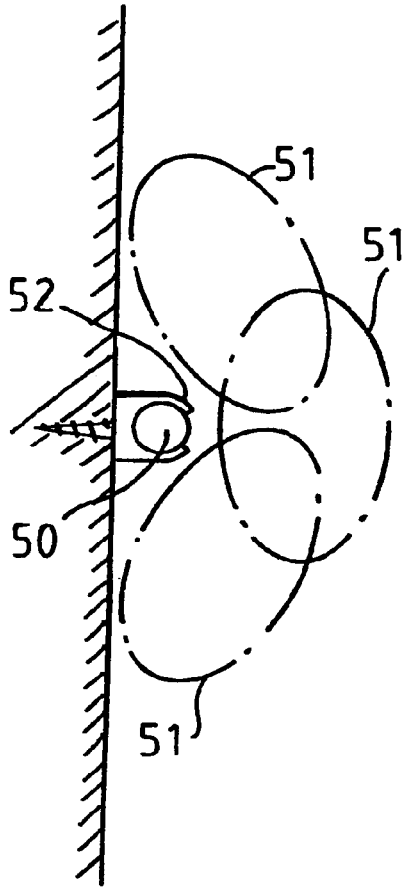

FIGS. 8A and 8B show a possible configuration for a manifold 50 having a sufficient length to support a plurality of separate towel holders 51. Each of the holders 51 is similar to that shown in FIG. 1, the holders being spaced along the manifold but also being displaced about the axis of the manifold as shown in FIG. 8B, to give easier access to the upper mouth of each holder.

Rather than have the manifold 50 secured to a wall, for example by means of a clamp arrangement interfitting therewith, the unit could be arranged as a floor-standing holder, especially where more than one towel holder 51 is provided. In this case, the manifold 50 may be provided with a base screwed to the floor.

I claim:

1. A heated towel holder comprising:

an elongate tube formed into the general shape of a conical helix and through which heated fluid is caused to flow said conical helix having a smaller end and a larger end; and a mounting arrangement for said elongate formed tube, said mounting arrangement being arranged to feed heated fluid into one end of the formed tube and to allow cooled fluid to run from the other end of the tube, said mounting arrangement holding the formed tube with the smaller end of the conical helix lowermost whereby at least part of a towel may be dropped into the conical volume bound by the helix so as to remain therein and be heated by fluid flowing through the formed tube.

2. A heated towel holder as claimed in claim 1, wherein the mounting arrangement includes a manifold comprising a tubular outer body adapted to be mounted in a generally vertical disposition so as to have an upper end and a lower end, the upper end of the body being closed off, an inner tube mounted within the outer body and communicating with the outer body at or adjacent its upper end, a first connector for said one end of the formed tube which first connector communicates with the interior of the outer body adjacent the upper end thereof, a second connector for said other end of the formed tube which second connector communicates with the interior of the outer body adjacent the lower end thereof, and means to introduce heated water to the inner tube, thereby in use promoting convection circulation of hot water through the formed tube defining the towel holder.

3. A heated towel holder as claimed in claim 2, wherein the inner tube is mounted on a closure for the lower end of the outer body, the inner tube being provided with a flow aperture adjacent the closure whereby water may pass from the outer body into the inner tube.

4. A heated towel holder as claimed in claim 2, wherein there is provided an end cap for the upper end of the outer body, the upper end of the inner tube locating on the end cap.

5. A heated towel bolder as claimed in claim 2, wherein the inner tube has at least one transverse opening at or adjacent each of its two ends within the outer body, whereby water may flow into the inner tube at the lower end thereof and out of the inner tube at the upper end thereof.

6. A heated towel holder as claimed in claim 2, wherein the inner tube is mounted on a closure for the lower end of the outer body so as to project internally within the outer body towards the upper end thereof, and the lower end of the inner tube communicating through the closure with a pipe connector of the closure for a hot-water supply pipe.

7. A heated towel holder as claimed in claim 6, wherein the closure has first and second flow passages, the inner tube connecting with one of the flow passages and the interior of the outer body communicating with the other flow passage.

8. A heated towel holder as claimed in claim 7, wherein each two flow passages is provided with a respective shut-off valve.

9. A heated towel holder as claimed in claim 9, wherein each shut-off valve is integrated with a pipe connector respectively for flow and return pipes of a domestic heating system.

10. A heated towel holder as claimed in claim 9, wherein the closure comprises a T-piece having first, second and third arms, the first arm being attached to the outer body and the shut-off valves being attached one to each of the second and third arms of the T-piece.

11. A heated towel holder as claimed in claim 6, wherein there is provided an end cap for the upper end of the outer body, the inner tube extending towards the end cap but the upper end of the inner tube being clear of the end cap thereby to allow out-flow of water from the inner tube into the upper end of the outer body.

12. A heated towel holder as claimed in claim 6, wherein the closure for the lower end of the outer body locates the lower end of the inner tube and has a flow passage leading to a connector portion to which is attached a valve assembly having a pipe connector for a hot water flow pipe of a domestic heating system.

13. A heated towel holder as claimed in claim 1, wherein the axis of the conical helix is inclined at an angle to the vertical when the mounting arrangement is secured to a vertical building surface.

14. A heated towel holder as claimed in claim 13, wherein the conical helix is of irregular form.

15. A heated towel holder as claimed in claim 1, wherein a multiplicity of separate towel holders each having an elongate tube formed into the general shape of a conical helix are connected to a common mounting arrangement with the multiplicity of towel holders being spaced apart thereon.

16. A heated towel holder as claimed in claim 15, wherein the multiplicity of separate towel holders are disposed on different levels to facilitate the holding of a plurality of towels.

17. A heated towel holder comprising:

an elongate tube formed into the general shape of a conical helix and through which heated fluid is caused to flow said conical helix having a smaller end and a larger end;

a mounting arrangement for said elongate formed tube, said mounting arrangement being arranged to feed heated fluid into one end of the formed tube and to allow cooled fluid to run from the other end of the tube, said mounting arrangement holding the formed tube with the smaller end of the conical helix lowermost whereby at least a part of a towel may be dropped into the conical volume bound by the helix so as to remain therein and be heated by fluid flowing through the formed tube;

wherein the mounting arrangement includes first and second parallel pipes adapted for mounting on a building surface to extend generally vertically, said one end of the formed tube being connected to the first pipe and said other end of the formed tube being connected to the second pipe.

18. A heated towel holder as claimed in claim 17, wherein the first and second pipes of the mounting arrangement are arranged for connection to a domestic hot water central heating system having flow and return pipes.

19. A heated towel holder comprising:

a multiplicity of separate towel holders each having an elongate tube formed into the general shape of a conical helix and through which heated fluid is caused to flow, said conical helix having a smaller end and larger end; and a common mounting arrangement for said elongate formed tubes, said mounting arrangement being arranged to feed heated fluid into one end of each tube and to allow cooled fluid to run from the other end of each tube, said mounting arrangement holding the formed tubes with the smaller end of each conical helix lowermost whereby at least a part of a towel may be dropped into the conical volume bound by the helix so as to remain therein and be heated by fluid flowing through the formed tube;

wherein the multiplicity of separate towel holders are spaced apart on the mounting arrangement and are disposed at different angular positions with respect to the vertical.

* * * * *